US009774142B1

(12) United States Patent
Rust

(10) Patent No.: US 9,774,142 B1
(45) Date of Patent: Sep. 26, 2017

(54) DATA CABLE, CONNECTOR, AND CRIMPING SYSTEM AND METHOD

(71) Applicant: Rustcraft Industries LLC, Exeter, NH (US)

(72) Inventor: Jonathan Austin Rust, Merrimack, NH (US)

(73) Assignee: Rustcraft Industries LLC, Exeter, NH (US)

( * ) Notice: Subject to any disclaimer, the term of this patent is extended or adjusted under 35 U.S.C. 154(b) by 0 days.

(21) Appl. No.: 15/464,391

(22) Filed: Mar. 21, 2017

Related U.S. Application Data

(63) Continuation of application No. 15/455,088, filed on Mar. 9, 2017, now abandoned.

(51) Int. Cl.

| | |
|---|---|
| ***H01B 11/08*** | (2006.01) |
| ***H01R 13/6463*** | (2011.01) |
| ***H01B 11/12*** | (2006.01) |
| ***H01R 43/048*** | (2006.01) |
| ***H01R 13/717*** | (2006.01) |

(52) U.S. Cl.
CPC ..... *H01R 13/6463* (2013.01); *H01B 11/08* (2013.01); *H01B 11/12* (2013.01); *H01R 13/717* (2013.01); *H01R 43/048* (2013.01)

(58) Field of Classification Search
USPC ..... 174/117 F
See application file for complete search history.

(56) References Cited

U.S. PATENT DOCUMENTS 3,663,739 A * 5/1972 Chevrier ..... H01B 7/08 174/117 F
4,232,444 A * 11/1980 Bolick, Jr. ..... H01R 43/28 29/426.4
4,404,424 A * 9/1983 King ..... H01B 7/0876 174/117 F (Continued)

FOREIGN PATENT DOCUMENTS

DE 3712968 A1 * 11/1988 ..... H01B 7/0876

OTHER PUBLICATIONS http://www.groundcontrol.com/galileo/ch5-ethernet.htm.

*Primary Examiner* — William H Mayo, III
*Assistant Examiner* — Krystal Robinson
(74) *Attorney, Agent, or Firm* — Anne-Marie Dinius; AMDinius Law

(57) ABSTRACT

The present invention relates to data cable and methods of installing/building data cable. The cable disclosed herein is indoor/outdoor and can be configured as 4-twisted pair, or any of the numerous other types of data cable. In one embodiment, we disclose an electrical data cable comprising a plurality of insulated wires wherein the plurality of insulated wires is coupled for a first portion of the length of the data cable so as to form at least one twisted pair of wires; the plurality of insulated wires is configured in a flat, planar arrangement for a second portion of the data cable; and the plurality of insulated wires is coupled for a third portion of the length of the data cable so as to form at least one twisted pair of wires. In an alternate method, we disclose a method of attaching a connector to the electrical data cable comprising the steps of cutting the data cable at the untwisted segment and attaching a connector to the plurality of insulated wires in the untwisted segment.

12 Claims, 6 Drawing Sheets

(56) References Cited

U.S. PATENT DOCUMENTS

| | | | | | |
|---|---|---|---|---|---|
| 4,413,469 | A * | 11/1983 | Paquin | H01B 7/0876 | 156/178 |
| 4,538,024 | A * | 8/1985 | Wise | B29C 47/027 | 174/117 F |
| 4,954,095 | A * | 9/1990 | Cogan | H01B 7/0009 | 174/115 |
| 4,973,238 | A * | 11/1990 | Kihlken | H01B 13/341 | 264/408 |
| 5,880,402 | A * | 3/1999 | Nugent | H01B 11/12 | 174/27 |
| 5,996,224 | A | 12/1999 | Sullivan | | |
| 6,017,237 | A | 1/2000 | Sullivan | | |
| 6,105,229 | A | 8/2000 | Sullivan | | |
| 6,370,769 | B1 | 4/2002 | Lilianthal, II | | |
| 6,635,826 | B2 * | 10/2003 | Yamamoto | H01B 7/0876 | 174/117 F |
| 7,085,533 | B1 * | 8/2006 | Rubinstein | H04W 84/10 | 370/338 |
| 7,415,760 | B2 | 8/2008 | Elias | | |
| 2010/0071202 | A1 | 3/2010 | Peng et al. | | |
| 2015/0280385 | A1 | 10/2015 | Jaramillo | | |
| 2015/0372439 | A1 | 12/2015 | Sullivan | | |

* cited by examiner

DATA CABLE, CONNECTOR, AND CRIMPING SYSTEM AND METHOD

FIELD

The present invention relates generally to a data cable, a connector, and a crimping system as well as methods of use thereof.

BACKGROUND

In recent years, the demand for data transmission within homes and office buildings has risen dramatically, with no end in sight. Indeed, as more things within the home or office become connected to the Internet of Things, the demand for quality, high speed data infrastructure will increase exponentially. In today's buildings, data are carried to the Internet backbone via Ethernet cable.

Ethernet Cable

FIG. 1 shows a perspective view of a typical prior art Ethernet cable 10. The cable 10 has four (4) twisted pair wires 12 encased within as well as an insulated external coating 11. The wires 12 are typically color coded. An exemplary color coding scheme could include wires 12 having the following color coding: (1) white and orange striped; (2) orange; (3) white and green striped; (4) blue; (5) white and blue striped; (6) green; (7) white and brown striped; and (8) brown.

Although cable 10 assemblies containing four (4) twisted pair of wires 12 are common, some Ethernet cables can have more. Indeed, some backbone assemblies utilize cable 10 having one hundred twisted pair. The teachings disclosed herein are equally applicable to these types of cables, as will be appreciated by those of skill in the art.

Ethernet cables carry broadband signals between your modem, router, computer, and other wired Internet-capable devices, and as such, they can accommodate data speeds associated with all levels of Internet service. The specifications for Ethernet cable are governed by standards promulgated by the IEEE. The first of these standards, 802.31 Ethernet standard 10BaseT, was promulgated in 1990. In 1991 the Electronic Industries Alliance ("EIA"), together with the Telecommunications Industry Association ("TIA"), published the first telecommunications cabling standard called EIA/TIA 568, which was based on Category 3 Unshielded Twisted Pair cable ("UTP").

Six months later, EIA and TIA published two additional standards, Category 4 ("Cat 4") and Category 5 ("Cat 5"). The Cat 4 standard specified data rates of up to 20 MHz, while the Cat 5 standard called for data rates of up to 100 MHz. At the time, these data rates must have seemed like ample bandwidth for future development, but it only took about ten years before Cat 5 was being pushed to its limits by new networking technologies.

The specification for Cat 5 cable was defined in ANSI/TIA/EIA-568-A, with clarification in TSB-95, the entire contents of which are hereby incorporated by reference. Cable types, connector types and cabling topologies were defined by TIA/EIA-568-B, the entire contents of which are hereby incorporated by reference.

The Cat 5 standard was improved upon in the Cat 5e standard by tightening some crosstalk specifications and introducing new crosstalk specifications that were not present in the original Cat 5 specification. The physical construction and bandwidth (100 MHz) of Cat 5 and Cat 5e is the same. Of note, Cat 5e supports speeds up to a Gigabit Ethernet (1,000 Mb/s) (100 MHz). Cat 5e cable 10 is suitable for Gigabit speeds and networks that change frequently. If the network changes frequently or is temporary in nature, Cat5 e may be the optimal selection.

The Cat 6 specification improves upon the Cat 5e specification by improving frequency response, tightening crosstalk specifications, and introducing more comprehensive crosstalk specifications. The improved performance of Cat 6 provides 250 MHz bandwidth and supports 10GBASE-T (10-Gigabit Ethernet). Cat 6 supports speeds up to 10 Gigabit Ethernet (1,000 Mb/s) (250 MHz), which can be achieved with distance of less than 55 meters or less, assuming high grade wire and quality installation. Cat 6A supports speeds up to 10 Gigabit Ethernet (10,000 Mb/s) (500 MHz) with a distance of up to 100 meters. Cat 6 cable 10 is optimal for extra margin and higher performance.

Cat7 and Cat 7A cable, which are relatively new to the industry, support speeds up to 10 Gigabit Ethernet with distance up to 100 meters (10,000 Mb/s)(1000 MHz). One additional difference between the early versions of Ethernet cable 10 and the Cat 7 family of cables 10 is, in Cat 7, each of the twisted pairs is separately insulated. If the Cat 7 cable 10 has four (4) twisted pair, for a total of eight (8) internal wires 12, there would be four separate shields around each of the four pair of twisted wire. Cat 7 cable 10 will support 10 Gigabit Ethernet with plenty of margin to spare. Cat 7 has pair-sharing capability, making it possible to use one cable to power several different devices at the same time utilizing each pair as needed. For the best and most versatile infrastructure, Cat 7 provides the solution.

As previously stated, the most common type of Ethernet cable 10 has four twisted pair of wires 12 inside of an insulated sheath 11. Each of the four pairs has differing precise number of twists per meter to minimize crosstalk between the pairs. One of the purposes of using twisted-pair wire 12 is to preserve a high signal-to-noise ratio despite interference from both external sources and crosstalk from other pairs.

Running Ethernet Cable

Those of skill in the art refer to the process of installing cable 10 within a building as "running cable." In essence, running cable entails physically placing cable throughout an entire structure, or a portion of a structure. This wiring is typically run in the space between interior and exterior walls of a building. In this way, data cabling is hidden from view, which is more aesthetically desirable. Individuals access the wired backbone within buildings via exterior wall jacks.

One common type of female connector that is used to terminate Ethernet cable runs at a wall jack is a keystone connector. A keystone module is a standardized snap-in package for mounting a variety of low-voltage electrical jacks or optical connectors into a keystone wall plate, face plate, surface-mount box, or a patch panel.

Keystone modules have a rectangular face of approximately 14.5 mm wide by approximately 16.0 mm high and are held in place with flexible tabs. This allows them to be snapped into a mounting plate with correspondingly-sized rectangular holes, called ports. All keystone connectors, regardless of the type of jack they carry, are interchangeable and replaceable. This provides flexibility in arranging and mounting many different types of electrical jacks in one plate or panel without requiring customized manufacturing.

FIG. 2A depicts a keystone connector 21 attached to a wall plate 22. As can be seen in FIG. 2A, the keystone connector is a "female" style connector, having eight ports 23, which are used to create an individual connection point with each of the eight wires within the Ethernet cable 10. In terms of accessing a wired backbone via a keystone connector 21 and wall plate 22, those of skill in the art typically use "male" connector, e.g., an RJ45 connector, attached to an Ethernet cable 10.

FIG. 2B depicts an RJ45 connector 24, which is frequently used to connect a device to the internal wiring of a building via a keystone connector 21. An RJ45 connector 24 is a modular 8-position, 8-pin connector used for terminating twisted pair cable, including without limitation, Cat5e, Cat6, Cat7, Cat8, and upward.

A pinout is a specific arrangement of wires that dictate how the RJ45 connector 24 is terminated. There are multiple pinouts for RJ45 connectors 24 including straight through (T568A or T568B), crossover, rolled, T1, and loopback. Straight through is the most common type of cable and can be used for numerous things including connecting a computer to a network.

In addition, many Ethernet cables include a low voltage power connection as well, which can be used to provide power to the connected device if desired. In this wiring scheme one or more of the wires 12 can carry a current along the wired backbone to the device. In some applications, for example tower cabling and other wiring configurations where there is potential for electrical surges, thunder, lightening, etc., the cable 10 can include a drain wire or shield cable, which is used as a grounding wire. In this configuration, a modified RJ45 connector 24 can be used, as is known in the art.

In terms of wiring standards, there are two recognized by ANSI, TIA and EIA. The first is the T568A wiring standard and the second is T568B, which is the more common of the two. Irrespective of which wiring scheme is chosen, those of skill in the art will recognize that the wiring scheme for the keystone connector 21 and the RJ45 connector 24 must match for the wiring to work in its intended function. In addition, although we have presented the wiring scheme for a single keystone connector 21 and a single RJ45 24 connector, skilled artisans often use patch panels when running cable.

In terms of the steps required to attach Ethernet cable to a keystone connector 21, an RJ45 connector 24, an connector within a patch panel, or similar connector, the following list describes the steps skilled artisans take when running cable: (1) cut cable 10 to length; (2) cut and remove outer casing of cable 10, exposing the four twisted pair; (3) carefully unwind the four twisted pair; (4) align each wire into the proper pattern depending upon the termination scheme, e.g., T568B; (5) straighten out the wires; (6) cut the ends of the wires to get a clean finish; (7) stick each of the eight (8) wires into the proper ports of the connector, for example and without limitation, a keystone connector 21 or an RJ45 connector 24; (8) check the alignment of the wires to ensure that they are at the end of the connector 21, 24 and that there is sufficient outer casing such that the outer casing of the wire is partially inside of the connector 21, 24; (9) crimp with a crimping tool; and (10) test the cable 10 to make sure that the proper electrical connectivity has been obtained from end-to-end. See e.g., http://www.groundcontrol.com/galileo/ch5-ethernet.htm.

FIG. 3 shows the tools that would typically be used to accomplish these tasks. FIG. 3 shows a punch tool 32, a connector 34, a crimping tool 36, a cutting tool 38, and a cable tester 39. The cutting tool 38 can be used to strip the outer casing off the Ethernet cable 10 and to cut the cable 10 itself or the individual wires within the cable 10. Alternatively, a user could use a knife, razor blade, wire cutters, scissors, an xacto knife, a utility knife, and so forth in place of the cutting tool 38. The connector 34 could be a Keystone jack, as pictured, an RJ45 connector, a 6-wire connector, an 8-wire connector, and similar connectors known to those of skill in the art.

The punch tool 32 is used to cut the ends of each of the individual wires once they have been properly placed within the ports located inside of a female style connector 34. If the connector 34 is a make style connector, e.g., an RJ45 connector 24, the crimping tool 36 is used to crimp the cable 10 into the connector 34. Most crimping tools 36 in use today can crimp a 6-wire connector 34, such as the old-style telephone connectors, and an 8-wire connector 34, such as an RJ45 connector 24. In addition, crimping tools 36 often come with a razor blade, which can be used to cut cable 10 and to strip insulation form wires. The cable tester 39 is used to test the quality of the connection between the cable 10 and the connector 34 as well as to ensure that there have not been any cuts made in any of the wires inside of the cable 10.

As can be seen from the list of steps required to attach a connector 34 onto a cable 10, as well as all the tools necessary to perform this task, this process can be quite time consuming and cumbersome. In addition, the steps involved require a tremendous amount of hand dexterity and close-up vision. Even for those individuals who have perfect hand-dexterity, that dexterity is compromised when running cable in colder temperatures or for extended periods of time. In addition, for those who require reading glasses, performing the steps above entails putting the readers on, taking them off, putting them on, taking them off, and so on. Accordingly, the process of running wire is time consuming and fraught with the potential for making mistakes.

As such, there is a need in the art for an improvement in the systems and methods used to run cable.

SUMMARY OF THE INVENTION

The invention disclosed herein overcomes the shortcoming of the prior art by disclosing a data cable that can be used to efficiently and accurately run cable on any size installation project. The cable disclosed herein is useable indoors and outdoors and can be configured as 4-twisted pair, or any of the numerous other types of data cable mentioned above and known to those of skill in the art. As standards evolve and new data speeds and cable configurations are adopted, the teaching disclosed herein will be equally applicable to future generations of cable and methods of installing cable.

In one embodiment, we disclose an electrical data cable comprising a plurality of insulated wires wherein the plurality of insulated wires is coupled for a first portion of the length of the data cable so as to form at least one twisted pair of wires; the plurality of insulated wires is configured in a flat, planar arrangement for a second portion of the data cable; and the plurality of insulated wires is coupled for a third portion of the length of the data cable so as to form at least one twisted pair of wires.

In an alternate embodiment, the electrical data cable can be comprised of eight total wires.

In an alternate embodiment, the electrical data cable can have a portion of its length be rigid.

In an alternate embodiment, the electrical data cable could also comprise a wire channel proximal to the flat, planar arrangement of the plurality of insulated wires in the second portion of the data cable.

In an alternate embodiment, the electrical data cable could further comprise a connector electrically coupled to the plurality of insulated wires.

In yet an alternate embodiment, the electrical data cable could additionally comprise a connector segment mechanically coupled to the wire channel wherein the connector segment or the wire channel is electrically coupled to the plurality of insulated wires.

In yet an alternate embodiment, the electrical data cable further comprises a wall plate.

In an alternate embodiment, the wall plate could be configured with an indicator light that would show if one of the wires in the electrical data cable was carrying a current.

In alternate embodiments, each of the above embodiments could be used to create a patch panel of connectors as opposed to a single connector.

A method of attaching a connector to an electrical data cable according comprising the steps of cutting a data cable at an untwisted segment of the data cable, the data cable further comprising a plurality of insulated wires coupled for a first portion of the length of the data cable so as to form at least one twisted pair of wires; the plurality of insulated wires configured in a flat, planar arrangement for a second portion of the data cable; and the plurality of insulated wires coupled for a third portion of the length of the data cable so as to form at least one twisted pair of wires; and attaching a connector to the plurality of insulated wires in the flat planar arrangement of the second portion of the data cable so as to create an electrically conducting connection between the plurality of insulated wires and the connector.

LIST OF REFERENCE NUMERALS

| Reference Number | Description |
|---|---|
| 10 | Cable |
| 11 | Insulated external coating |
| 12 | Wires - list color coding |
| 21 | Keystone connector |
| 22 | Wall plate |
| 23 | Ports |
| 24 | RJ45 connector |
| 32 | Punch tool |
| 34 | Connector |
| 36 | Crimping tool |
| 38 | Cutting tool |
| 39 | Cable tester |
| 40 | Data cable |
| 41 | Untwisted segment |
| 42 | Insulated wires |
| 43 | Twisted segment |
| 44 | Wire channel |
| 45 | Insulated portion |
| 46 | Connector segment |

DETAILED DESCRIPTION

The present invention overcomes these hurdles in the prior art by providing a new Ethernet cable and connector system and methods of using the same. The embodiments described herein save time by reducing the number of steps and the requisite skill required to create Ethernet cables.

Figure 1:
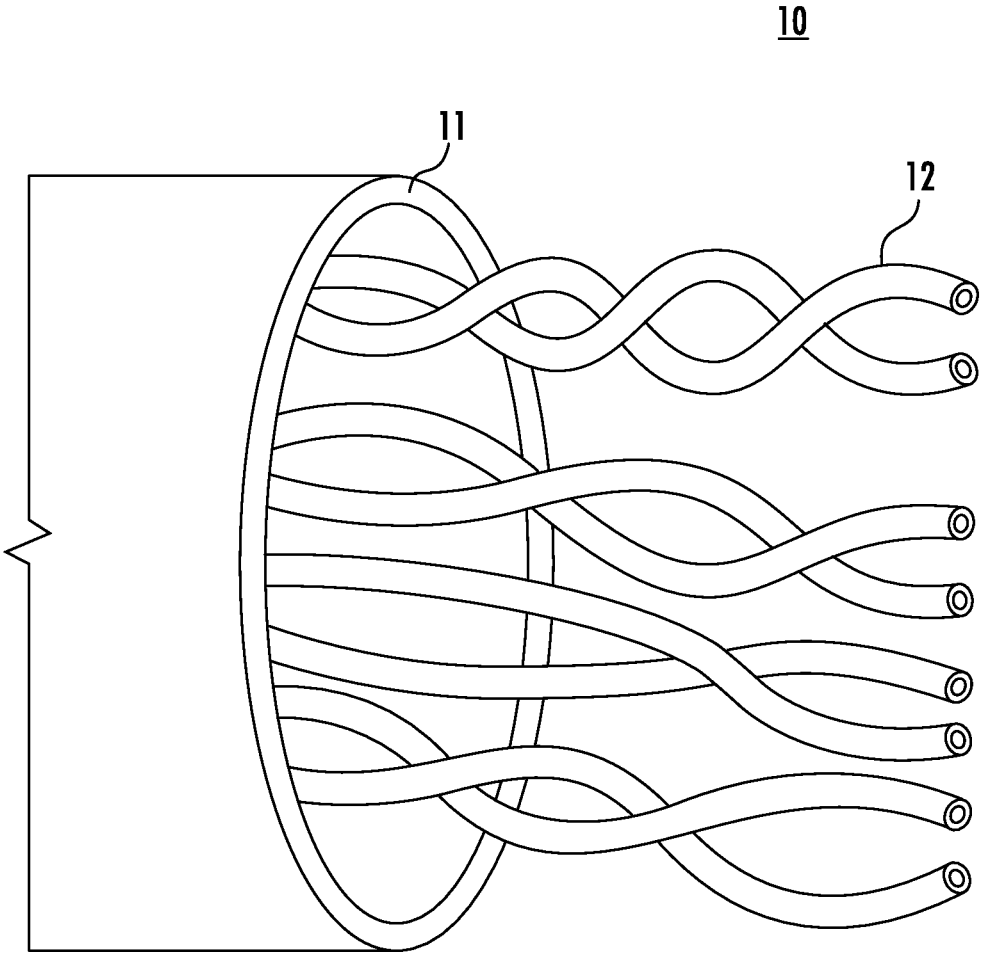
FIG. 1 PRIOR ART
FIG. 1 (prior art) is a left side view of a section of Ethernet cable having four (4) twisted pair.
Figure 2A:
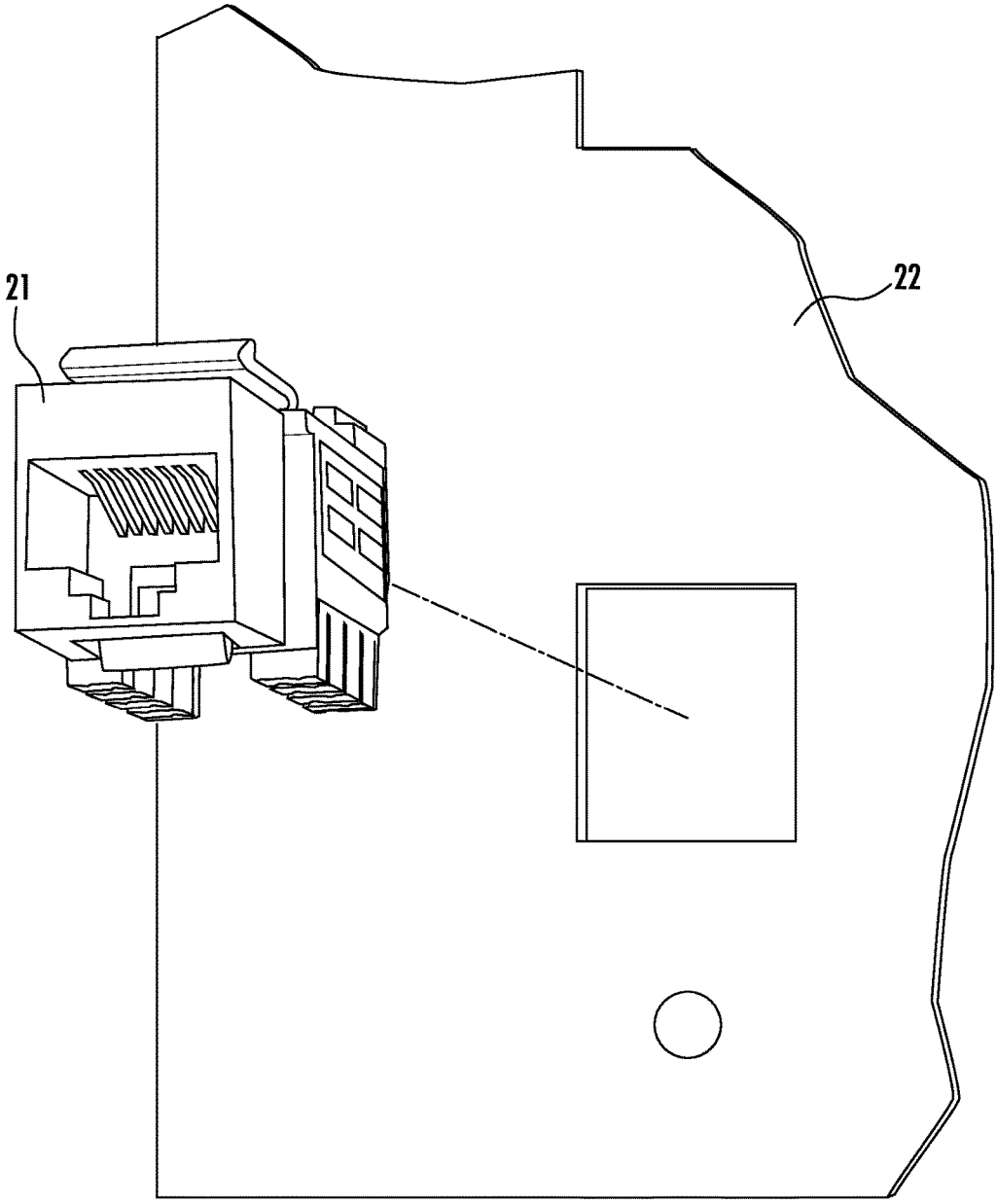
FIG. 2A PRIOR ART
FIG. 2A (prior art) is a perspective view of a keystone connector attached to a wall plate.
Figure 2B:
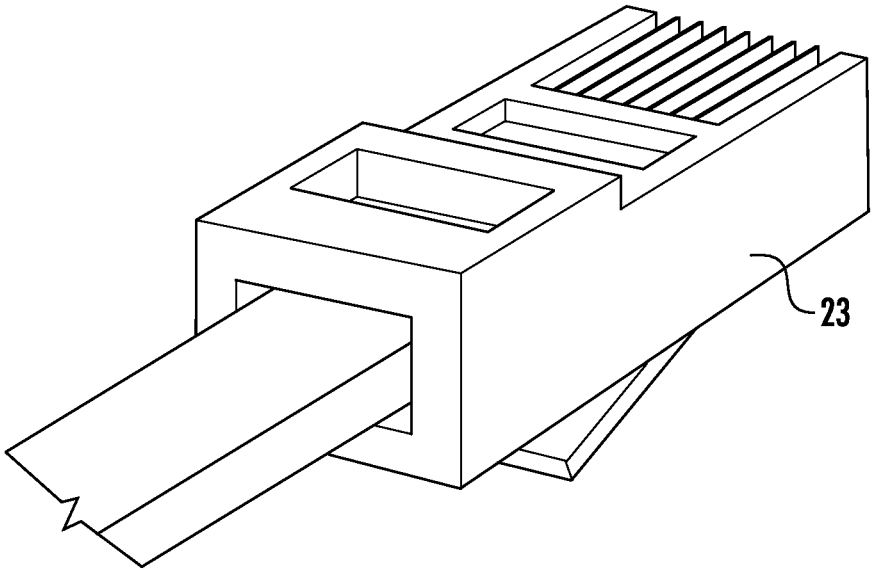
FIG. 2B PRIOR ART
FIG. 2B (prior art) is a perspective view of an RJ45 connector.
Figure 3:
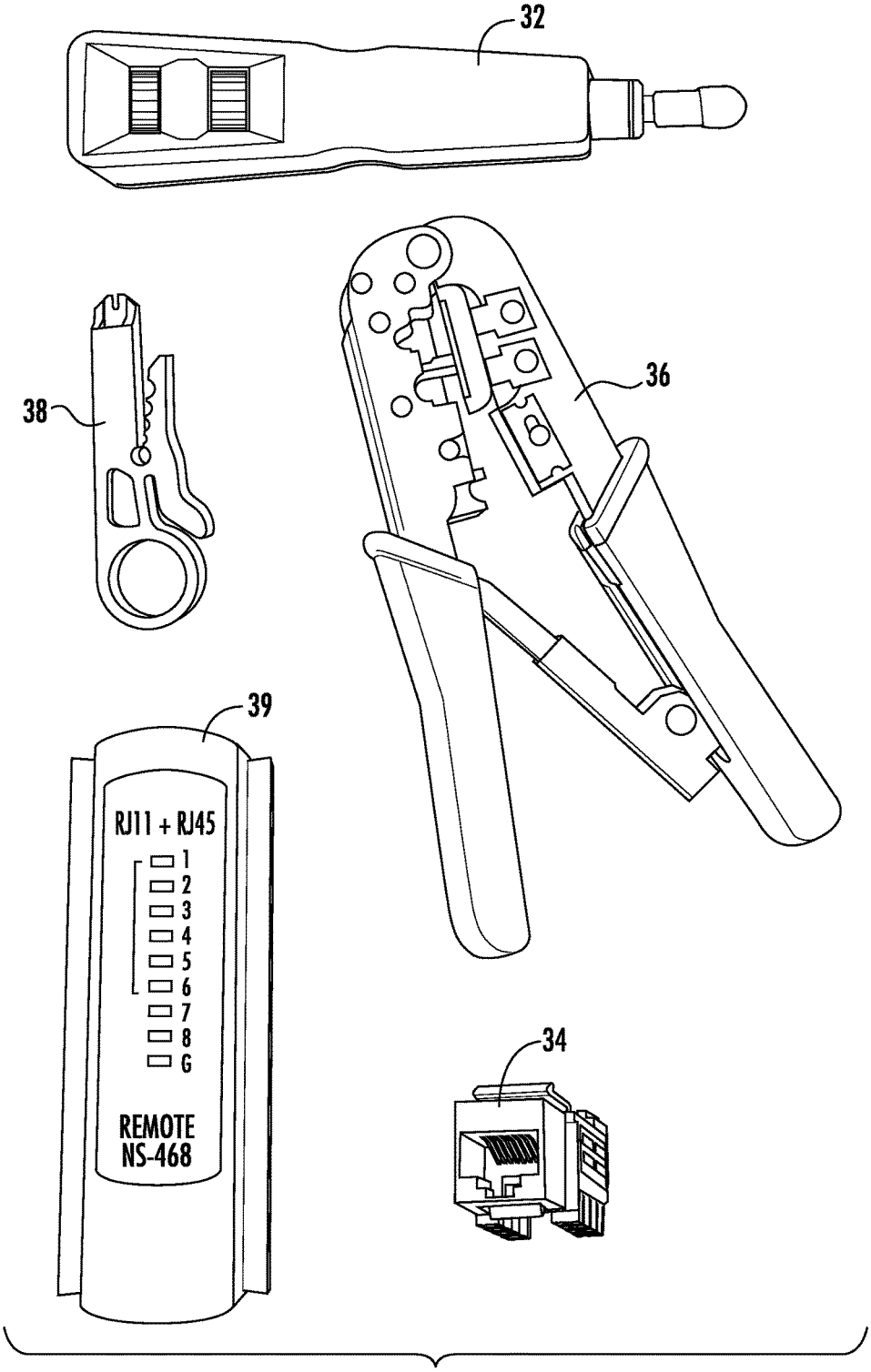
FIG. 3 PRIOR ART
FIG. 3 (prior art) is a top view of prior art tools needed to attach a connector to cable.
Figure 4A:
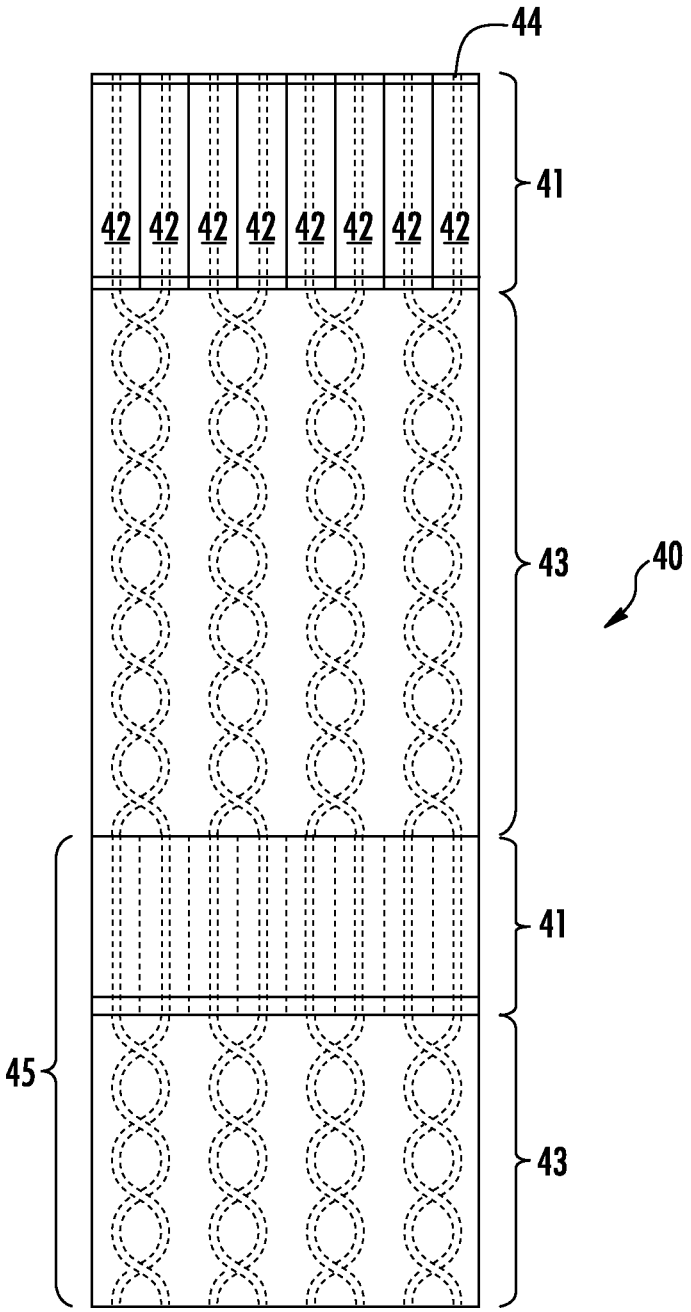
FIG. 4A is a top view of an embodiment of the data cable disclosed herein.

FIG. 4A depicts embodiments of the inventive Ethernet cable 40 having an alternating twisted, untwisted pattern. In these embodiments, cable 40 could be any data cable constructed in accordance with widely accepted standards. The total number of insulated wires 42 contained within the data cable 40 could vary from as low as two, to hundreds or even thousands of wires.

Today's data cables 40 are primarily comprised of eight (8) insulated, twisted pair of wires. As such, and without limitation, this configuration will be used as an exemplary data cable 40 for purposes of discussing the inventive concepts herein. Ideally, the insulated wire 42 used within the data cable 40 will adhere to a standard configuration. FIG. 4A shows a T568B wiring configuration, which could be one embodiment of the cable 40. In alternate embodiments, the wiring configuration can vary and each spool of wire could be labeled so that skilled artisans will know the exact configuration of the wires 42 in the untwisted segment 41 of the cable 40. This will save practitioners time and will reduce errors in running cable.

Exemplary standards for eight twisted pair cable include: Cat 5, Cat 5e, Cat 6, and Cat 7. The embodiments disclosed herein would work with a data cable 40 falling within any of these standards as well as additional standards known to those of skill in the art.

Of note, those of skill in the art will recognize that these standards allow for the provision of power through the cable 40. This configuration is known as Power Over Ethernet. The power is obtained by supplying a voltage to one or more of the insulated wires 42. The embodiments discussed herein are available with or without power over Ethernet versions. Moreover, the embodiments disclosed herein can be used with many types of wire, including, but not limited to, Plenum, direct burial, drain wire, gel filled, shielded, unshielded, and UV protected.

FIG. 4A depicts a cable embodiment having a twisted segment 43 and an untwisted segment 41. While FIG. 4A depicts two sections of the twisted segment 43 and two sections of the untwisted segment 41, in embodiments these segments continue on throughout the length of a spool of data cable 40.

In the top portion of FIG. 4A, the cable insulation has been removed to show how the wires 42 are configured underneath the insulated exterior of the cable 40. In the insulated portion 45 of the cable 40, the twisted segment 43 and the untwisted segment 41 are covered with an insulated coating. Most typically, the cable 40 will be covered for its length by insulation until an installer removes the insulation when running cable or attaching connectors.

As can be seen from FIG. 4A, the twisted segment 43 comprises four twisted pair of insulated wire 42 in the embodiment depicted. In the embodiment of FIG. 4A, the wires 42 could be color-coded as describe above when referring to the prior art. In alternate embodiments, the color coding scheme could be different or non-existent. Those of skill in the art will recognize that some cable 40 optionally includes a ground wire, not pictured, which could additionally be a part of the embodiments disclosed herein.

Additionally, those of skill in the art will recognize that the number of insulated wires 42 within the cable 40 could vary in alternate embodiments. At a minimum, the embodiments contemplated herein would be comprised of at least two insulted wires 42 forming a single twisted pair for a portion of the cable 40, i.e., the twisted pair segment 43 and lying flat in a planar fashion for the untwisted segment 41 of the cable 40. In preferred embodiments, there would be four-twisted pair, or eight total wires 42.

The twisted segment 43 of the cable 40 is typically longer than the untwisted segment 41 of the cable 40, although it some embodiments, the lengths of twisted segment 43 and the untwisted segment 41 could be equal. And in alternate embodiments, the length of the untwisted segment 41 could be longer than the length of the twisted segment 43. For purposes of illustration and without limitation, the cable 40 could alternate between twisted segments 43 and untwisted segments 41 every foot. Specifically, the twisted segment 43 of the cable 40 could be eleven inches, while the untwisted segment 41 could be an inch. This scheme could alternate every foot of the data cable 40 for the full length of the spool of cable 40.

The lengths and proportionality of twisted segments 43 versus untwisted segments 41 can vary according to the type of job being performed as well as consumer and/or manufacturing preferences. In the one-foot alternating pattern described above, it would be convenient to have an untwisted segment 41 approximately every foot because that would allow less waste when cutting cable 40 for a particular run or for a particular length.

Figure 4B:
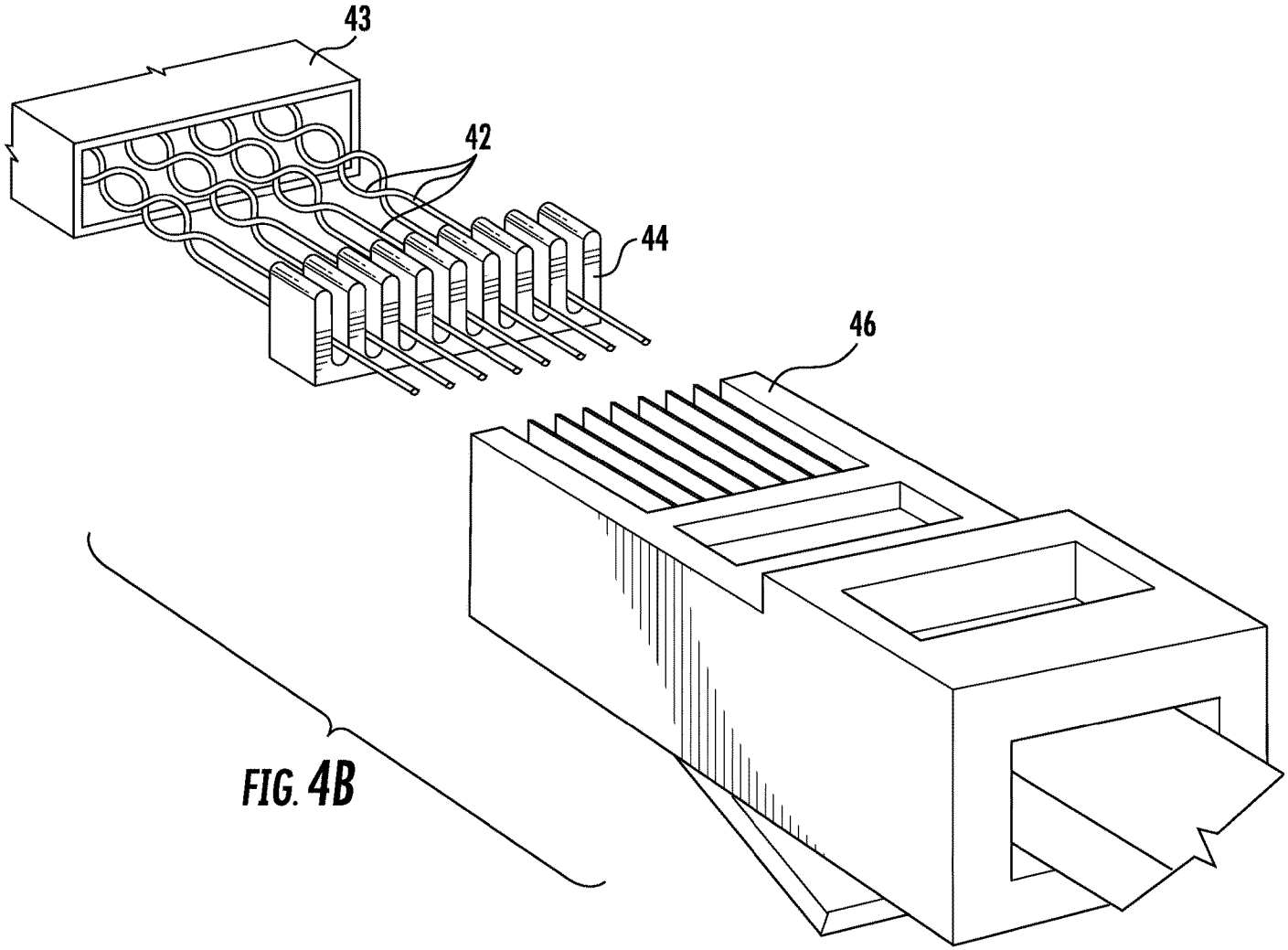
FIG. 4B is a perspective view of a wire channel and a connector segment according to embodiments herein.

FIG. 4A also depicts a wire channel 44 used to keep the wires flat and stationary in the untwisted segment 41 of the cable 40. FIG. 4B shows a perspective view of the wire channel 44 having the wires 42 lying in the individual channels within the wire channel 44. In alternate embodiments, the portion of wire 42 residing in the untwisted segment 41 could have an exterior insulated portion that is more rigid than the insulation on the wires lying within the twisted segment 43. This rigidity could assist the wire 42 in maintaining a flat, planar orientation in the untwisted segment 41 of the cable 40.

In some embodiments, the wire channel 44 can be designed to mechanically couple to a connector segment 46. FIG. 4B depicts the wire channel 44 with insulated wires 42 disposed therewithin. In addition, a connector segment 46, which can be configured in some embodiments to electrically couple to wires 42, is shown. The electrical coupling could be achieved with a crimping tool, a punch tool, by hand, or similar techniques known to those of skill in the art.

The connector segment 46 can also be configured in alternate embodiments to mechanically couple to wire channel 44. The mechanical connection between the wire channel 44 and the connector segment 46 could be made by snapping the two pieces together, by crimping the two pieces together, by mechanically coupling the two pieces together, by adhering the two pieces together and so forth. When the wire channel 44 is connected to the connector segment 46. The termination portion of the connector segment 46 can be either male or female and can be Ethernet, telephone wire, and the like.

In one embodiment, the wire channel 44 and the connector segment 46 combine to create an RJ45 21 connector. In another embodiment, the wire channel 44 and the connector segment 46 combine to create a keystone connector 21. In some embodiments, the arms of the wire channel 44 could contain a small latching mechanism that would be configured to mechanically couple to a symmetrically receiving portion within the connector segment 46.

In alternate embodiments, the cable 40 and connectors could be coupled to a wall plate or a patch panel.

As previously stated, the steps required to attach a connector to a segment of data cable in the prior art were as follows: (1) cut cable 10 to length; (2) cut and remove outer casing of cable 10, exposing the four twisted pair; (3) carefully unwind the four twisted pair; (4) align each wire into the proper pattern depending upon the termination scheme, e.g., T568B; (5) straighten out the wires 12; (6) cut the ends of the wires 12 to get a clean finish; (7) stick each of the eight (8) wires 12 into the proper ports of the connector, for example and without limitation an RJ45 connector 24, or separate pairs and use punch tool for Keystone connector 21; (8) check the alignment of the wires to ensure that they are at the end of the connector 21, 24 and that there is sufficient outer casing such that the outer casing of the wire 12 is partially inside of the connector 21, 24; (9) crimp with a crimping tool 36; and (10) test the cable 10 to make sure that the proper electrical connectivity has been obtained from end-to-end.

With reference to FIGS. 4A & 4B, the steps required to secure a connector to a data cable according to embodiments disclosed herein can be reduced as follows. (1) cut cable 40 to length; (2) attach connector to the wires; (3) crimp with a crimping tool or similar device to create an electrical connection between the metal ports in the connector; and (4) test the cable 40 to ensure that proper electrical connectivity has been achieved. In this method, the connector could be an off-the-shelf keystone connector 21, an off-the-shelf RJ45 connector 23, or a proprietary connector comprised of the wire channel 44 and the connector segment 46.

In this method, the following steps have been eliminated for the following reasons: (1) carefully unwind the four twisted pair—there is no need to untwist the twisted pair because they have been untwisted and properly aligned in the untwisted segment 41 of the cable 40; (2) cut and remove outer casing of cable 40, exposing the four twisted pair—as above there is no need to untwist the twisted pair because they have been untwisted and properly aligned in the untwisted segment 41 of the cable 40; (3) align each wire into the proper pattern depending upon the termination scheme, e.g., T568B—there is no need to align the wires in the proper pattern because they have been pre-aligned in the proper pattern; (4) straighten out the wires—the wires 42 in the untwisted segment 41 are flat and planar so they do not have to be straightened out; (5) cut the ends of the wires to get a clean finish—the wires 42 in the untwisted segment of the cable 40 are of uniform length, thereby obviating the need to cut for a clean finish; and (6) check the alignment of the wires to ensure that they are at the end of the connector 21, 23 and that there is sufficient outer casing such that the outer casing of the wire is partially inside of the connector 21, 23—the wires 42 in the untwisted segment of the cable 40 are of uniform length, thereby obviating the need to ensure that there is a sufficient outer casing on the cable 40.

Those of skill in the art will recognize throughout this specification that when like terms are used to describe features and functionalities of various portions of a particular embodiment, those same features and functionalities could be present in additional embodiments having aspects with like terms. In addition, the teachings of the invention disclosed herein could be used with other types of cables such as telephone and video cables, as will be recognized by those of skill in the art.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The terms "coupled to" or "connected to" are intended to mean both a direct coupling or connection as well as a coupling or connection where there are one or more intermediary elements, devices, parts, and the like.

The invention includes embodiments in which exactly one member of the group is present in, employed in, or otherwise relevant to a given product or process. The invention also includes embodiments in which more than one or the entire group of members is present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise.

Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification, embodiments have been described in a way which enables a clear and concise specification to be written, but it is intended and will be appreciated, that embodiments may be variously combined or separated without departing from the invention. It is intended that the present invention be limited only to the extent required by the appended claims and the applicable rules of law.

What is claimed is:

1. An electrical data cable comprising a plurality of insulated wires wherein:

a. the plurality of insulated wires is coupled for a first portion of the length of the data cable so as to form at least one twisted pair of wires;

b. the plurality of insulated wires is configured in a flat, planar arrangement for a second portion of the data cable, further comprising a member having a plurality of grooves wherein the grooves are configured to house at least one insulated wire in the second portion of the data cable; and c. the plurality of insulated wires is coupled for a third portion of the length of the data cable so as to form at least one twisted pair of wires.

2. The electrical data cable of claim 1 wherein the number of insulated wires in the plurality of insulated wires is equal to eight.

3. The electrical data cable of claim 1 wherein a portion of the insulation on the exterior of the plurality of insulated wires is rigid.

4. The electrical data cable of claim 1 further comprising a connector electrically coupled to the plurality of insulated wires.

5. The electrical data cable of claim 4 further comprising a wall plate.

6. The electrical data cable of claim 5 wherein the wall plate further comprises a light configured to signal a current in at least one of the insulated wires.

7. The electrical data cable of claim 4 further comprising a patch panel.

8. The electrical data cable of claim 1 further comprising a connector segment mechanically coupled to the wire channel wherein the connector segment or the wire channel is electrically coupled to the plurality of insulated wires.

9. The electrical data cable of claim 8 further comprising a wall plate.

10. The electrical data cable of claim 9 wherein the wall plate further comprises a light configured to signal a current in at least one of the insulated wires.

11. The electrical data cable of claim 8 further comprising a patch panel.

12. A method of attaching a connector to an electrical data cable comprising the steps of:

a. cutting a data cable at an untwisted segment of the data cable, the data cable further comprising:

i. a plurality of insulated wires coupled for a first portion of the length of the data cable so as to form at least one twisted pair of wires;

ii. the plurality of insulated wires configured in a flat, planar arrangement for a second portion of the data cable further comprising a member having a plurality of grooves wherein the grooves are configured to house at least one insulated wire in the second portion of the data cable; and iii. the plurality of insulated wires coupled for a third portion of the length of the data cable to form at least one twisted pair of wires; and iv. attaching a connector to the plurality of insulated wires in the flat planar arrangement of the second portion of the data cable to create an electrically conducting connection between the plurality of insulated wires and the connector.

* * * * *